United States Patent [19]

Kestenman et al.

[11] Patent Number: 4,676,076

[45] Date of Patent: Jun. 30, 1987

[54] FLEXIBLE BRACELET CONSTRUCTION

[75] Inventors: Sumner S. Kestenman, Pawtucket; Louis P. Macedonio, Johnston, both of R.I.

[73] Assignee: Textron, Inc., Providence, R.I.

[21] Appl. No.: 792,692

[22] Filed: Oct. 28, 1985

[51] Int. Cl.[4] ..... H44C 5/02

[52] U.S. Cl. ..... 63/4; 59/80

[58] Field of Search ..... 63/4, 3; 59/80, 90, 59/85, 82

[56] References Cited

U.S. PATENT DOCUMENTS

| | | | |
|---|---|---|---|
| 1,821,676 | 9/1931 | Simpson | 63/4 X |
| 1,860,186 | 5/1932 | Kestenman | 63/4 X |
| 3,429,142 | 2/1969 | Brunet | 63/4 |
| 3,609,963 | 10/1971 | Ichinose | 63/4 |
| 3,845,618 | 11/1974 | Meyerson | 63/4 |
| 4,452,036 | 6/1984 | Gay | 63/4 X |

FOREIGN PATENT DOCUMENTS

| | | | |
|---|---|---|---|
| 273169 | 4/1951 | Switzerland | 63/4 |

*Primary Examiner*—Richard J. Johnson

*Attorney, Agent, or Firm*—Salter & Michaelson

[57] ABSTRACT

A flexible bracelet construction comprises at least one longitudinally extending row of transversely extending tubular link elements and a plurality of staple elements which extend inwardly into the link elements from the side edge portions of the bracelet for flexibly interconnecting the link elements in aligned side-by-side relation. The staple elements each comprise a head portion and a pair of leg portions which extend in spaced, substantially parallel relation from the head portion thereof. The head portions of the staple elements are positioned adjacent and end edges of the tubular link elements when the staple elements are assembled in the bracelet and the head portions are formed in enlarged dimensions to conceal the end edges of the link elements and to better retain the link elements on the bracelet when the bracelet is constructed with a plurality of rows of link elements.

6 Claims, 4 Drawing Figures

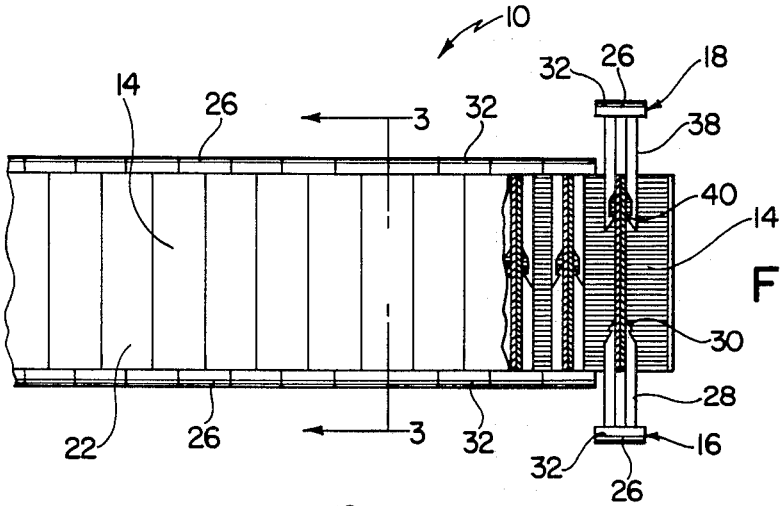
FIG. 1
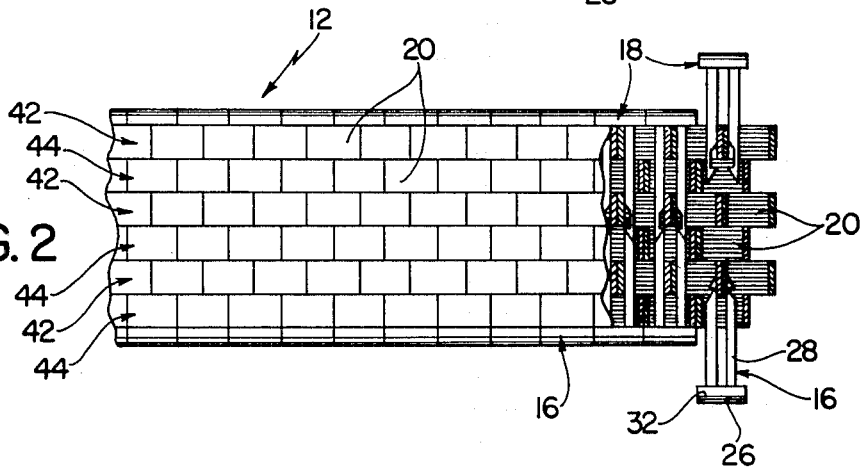
FIG. 2
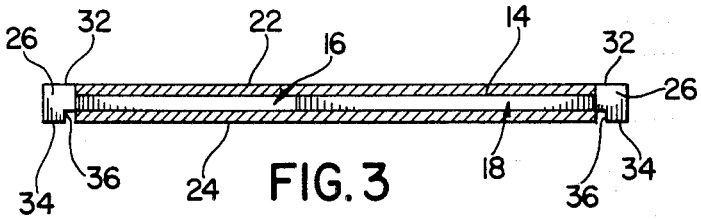
FIG. 3
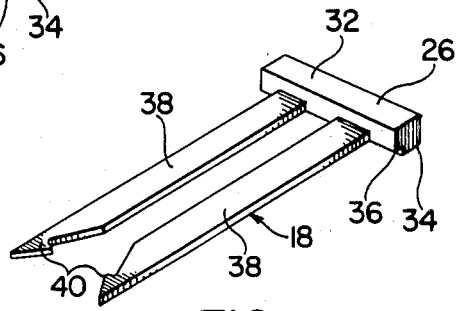
FIG. 4
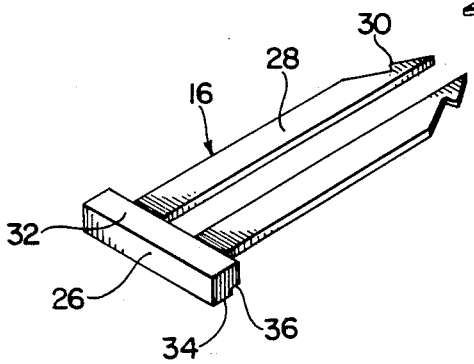

FLEXIBLE BRACELET CONSTRUCTION

BACKGROUND AND SUMMARY OF THE INVENTION

The instant invention relates to flexible bracelets and more particularly to an improvement in a flexible bracelet construction of a type which is commonly used for watchbands and the like.

Bracelets of the type disclosed in the U.S. patent to KESTENMAN U.S. Pat. No. 1,860,186 which issued on May 24, 1932, represented a significant advancement in the jewelry art when they were originally developed. In fact, bracelets of this type have proven to be popular and effective ever since the time that they were initially offered for sale over fifty years ago. However, not withstanding this fact, certain improvements in bracelets of this general type have now been developed which are the subject of the instant invention.

Bracelets of the type disclosed in the U.S. patent to KESTENMAN U.S. Pat. No. 1,860,186, comprise a longitudinally extending row of adjacent transversely extending tubular link elements and a plurality of pairs of male and female staple elements which flexibly interconnect the link elements in substantially aligned side-by-side relation. The male and female staple elements of the bracelet each comprise a head portion and a pair of leg portions which extend in generally parallel spaced relation from their respective head portion and the staple elements are formed so that the leg portions of the male staple elements are receivable in interlocked relation with the leg portions of the female staple elements. The male and female staple elements are assembled in the bracelet with adjacent link elements so that the two leg portions of each staple element are received in different adjacent link elements and so that the male and female staple elements extend inwardly from opposite ends of the adjacent link elements. Bracelets of this general type have been embodied in constructions comprising single longitudinally extending rows of elongated transversely extending link elements, as well as in constructions comprising pluralities of longitudinally extending rows of transversely extending shortened link elements, wherein the link elements in adjacent rows are offset with respect to each other to impart "basket weave" type appearances to their respective bracelets. In either case, however, the adjacent link elements of bracelets of this type have been flexibly interconnected with staple elements which extend inwardly from opposite ends of the link elements, and which are received in engagement with each other in the interiors of the respective link elements thereby connected. Heretofore, the staple elements which have been utilized in bracelet constructions of this type have generally been made of sheet materials and the head and leg portions thereof have had substantially the same thicknesses, and they have necessarily been constructed so that the leg portions thereof have had thicknesses which are less than the thicknesses of the open interior areas of the tubular link elements thereby connected. Unfortunately, however, when a flexible bracelet is constructed with staple elements of this type, the end edges of the link elements are exposed along the side edge portions of the bracelet and this detracts from the overall aesthetic appearance of the bracelet. Further, when a "basket weave" type bracelet is constructed in this manner, it can only be made with an odd number of rows of link elements. This is because when a "basket weave" type bracelet is constructed with an even number of rows of tubular link elements, the staple elements along one side edge of the bracelet are received in and surrounded by single link elements, rather than being received in pairs of adjacent link elements. As a result, the link elements along this one side edge can be inadvertantly removed from the bracelet and the staple elements along this edge can slide inwardly into the bracelet.

The instant invention effectively overcomes the disadvantages of the heretofore known bracelets of the above described type and it represents a further significant advancement in the jewelry art. Specifically, the bracelet construction of the instant invention comprises a plurality of link elements which are similar to those hereinabove described and a plurality of pairs of staple elements for flexibly interconnecting the link elements. However, the staple elements are formed with enlarged head portions having thicknesses which are greater than the thicknesses of the openings in the respective adjacent link elements thereby connected. Preferably, the head portions of the staple elements have thicknesses which are approximately equal to the overall thicknesses of the link elements so that the head portions of the staple elements conceal the end edges of the link elements along the side edges of the bracelet to enhance the aesthetic appearance of the bracelet. in any event, because of the enlarged head portions of the staple elements, the bracelet construction of the instant invention can be effectively embodied in "basket weave" type bracelets having even numbers of rows of link elements. This is because even when the staple elements are received in and surrounded by single link elements, the link elements cannot slide past the head portions of the staple elements so that the link elements and the staple elements are maintained in properly assembled relation along both side edges of the bracelet. Hence, the bracelet construction of the instant invention has substantially improved aesthetic qualities since the head portions of the staple elements conceal the end edges of the link elements along the side edges of the bracelet, and it also has increased versatility since it can be effectively embodied in "basket weave" type constructions having even numbers of rows of link elements.

Accordingly, it is a primary object of the instant invention to provide an improved flexible bracelet construction.

Another object of the instant invention is to provide a bracelet construction comprising a plurality of link elements and a plurality of staple elements which interconnect the link elements, wherein the ends of the link elements along the opposite side edges of the bracelet are concealed.

A still further object of the instant invention is to provide an effective bracelet construction comprising an even number of rows of link elements which are assembled in a "basket weave" type construction, wherein the link elements are flexibly interconnected with staple elements.

Other objects, features and advantages of the invention shall become apparent as the description thereof proceeds when considered in connection with the accompanying illustrative drawings.

DESCRIPTION OF THE DRAWING

In the drawings which illustrate the best mode presently contemplated for carrying out the present invention:

FIG. 1 is a fragmentary plan view of a first embodiment of the bracelet construction of the instant invention;

FIG. 2 is a fragmentary plan view of a second embodiment of the bracelet construction of the instant invention;

FIG. 3 is an enlarged sectional view taken along line 3—3 in FIG. 1; and

FIG. 4 is an enlarged perspective view of a pair of the staple elements of the bracelet construction of the instant invention.

DESCRIPTION OF THE INVENTION

Referring now to the drawing, a first embodiment of the bracelet construction of the instant invention is illustrated and generally indicated at 10 in FIGS. 1 and 3, and a second embodiment of the bracelet construction is illustrated and generally indicated at 12 in FIG. 2. The bracelet construction 10 comprises a single longitudinally extending row of elongated transversely extending tubular link elements generally indicated at 14 and a plurality of pairs of male and female staple elements generally indicated at 16 and 18, respectively, which flexibly interconnect the link elements 14. The bracelet 12, which is a "basket weave" type bracelet, comprises a plurality of longitudinally extending rows of shortened transversely extending tubular link elements generally indicated at 20 and a plurality of pairs of male and female staple elements 16 and 18, respectively, which flexibly interconnect the link elements 20 so that they define a plurality of adjacent longitudinally extending rows of link elements 20 wherein the link elements 20 in adjacent rows are longitudinally offset with respect to each other.

Referring now more specifically to the bracelet 10, the link elements 14 are preferably formed in elongated, partially flattened, tubular configurations so that they have front and rear and sides 22 and 24, respectively, as illustrated in FIG. 3. The link elements 14 are preferably made of a suitable decorative sheet metal and they are preferably disposed in substantially aligned side-by-side relation in the bracelet 10 so that opposite ends of the link elements 14 face opposite side edges of the bracelet 10. As will be seen from FIG. 3, the link elements 14 are of partially flattened configuration so that the thicknesses thereof, i.e. the distances from the front sides 22 thereof to the rear sides 24 thereof, define the thickness of the central portion of the bracelet 10. The link elements 14 are, however, dimensioned to receive the male and female staple element 16 and 18, respectively, therein for interconnecting the link elements 14 as illustrated in FIGS. 1 and 3. The link elements 14 are disposed in side-by-side relation in the bracelet 10 so that they define an elongated row of link elements 14 and so that the front and rear sides 22 and 24, respectively of the link elements 14 define the front and rear sides of the bracelet 10.

Referring now to FIG. 4, the male and female staple elements 16 and 18, respectively, are illustrated. The male staple elements 16 each comprise an enlarged head portion 26 and pair of spaced leg portions 28 which extend in substantially parallel relation from their respective head portion 26. The leg portions 28 are formed in substantially flattened configuration so that they are receivable in the link elements 14 and they are formed with outwardly facing notched teeth 30 thereon adjacent the terminal ends thereof. The head portions 26 of the male staple elements 16 are formed in enlarged dimensions so that they have thicknesses which are greater than the thicknesses of the tubular interiors of the link elements 14 and preferably so that they have thicknesses which are approximately equal to the overall thicknesses of the link elements 14. As illustrated in FIG. 3, the head portions 26 have front and rear sides 32 and 34, respectively, and they are dimensioned so that when they are assembled with the link elements 14, the longitudinal extents of the head portions 26 in the bracelet 10 are substantially equal to the widths of the link elements 14. The rear sides of the head portions 26 are formed with notches 36 along the inner portions thereof which extend longitudinally with respect to the bracelet 10 when the male staple elements 16 are assembled with the link elements 14. As a result, when the staple elements 16 are assembled with the link elements 14, the rear portions of the head portions 26 of the male staple elements 16 are spaced outwardly slightly from the adjacent ends of the link elements 14. The female staple elements 18 are similar in construction to the male staple elements 116 and they include head portions 26 and leg portions 38 having inwardly facing notched teeth 40 thereon. The leg portions 38 extend in substantially parallel spaced relation from their respective head portions 26 and they are dimensioned and configured to receive the notched teeth 30 of the male staple elements 16 in interengagement with the notched teeth 40. The head portions 26 of the female staple elements 18 are also formed in enlarged dimensions so that they have thicknesses which are approximately equal to the thicknesses of the link elements 14 and notches 36 are formed in the rear side portions of the head portions 26 of the female staple elements 18. Further, both the male and female staple elements 16 and 18 are dimensioned so that when the leg portions 28 and 38, respectively, thereof are received in interengagement in the link elements 14, the head portions 26 thereof are positioned adjacent the end edges of the link elements 14 along the side edge portions of the bracelet 10. Accordingly, when the staple elements 16 and 18 are assembled with the link elements 14, the notches 36 define grooves between the head portions 26 and the edges of the link elements 14 on the rear side of the bracelet 10. This permits the staple elements 16 and 18 to be disengaged from each other to adjust the length of the bracelet 10 by inserting a prying instrument, such as a small screwdriver, in the groove and twisting it to force the respective head portion 26 outwardly and to thereby disengage the respective pair of staple elements 16 and 18. The staple elements 16 and 18 are each further dimensioned so that the leg portions 28 and/or 38, respectively, of two staple elements 16 and/or 18 are receivable in side-by-side relation in the same link element 14 to enable the staple elements 16 and 18 to be utilized for interconnecting the adjacent link elements 14 as illustrated.

Referring now to FIG. 2, the bracelet 12 is illustrated. The bracelet 12 comprises a plurality of longitudinally extending rows of transversely extending, partially flattened, shortened tubular link elements 20 which are flexibly interconnected with a plurality of pairs of staple elements 16 and 18. The shortened link elements 20 in adjacent rows are, however, longitudinally offset with respect to each other by approximately one-half the width of a link element 20 in order to impart a "basket weave" type appearance to the bracelet 12. Accordingly, the staple elements 16 and 18 actually only interconnect the link elements 20 in alternating rows, such as the connected rows generally indicated at 42, whereas both of the legs 28 and 38 of the staple elements 16 and/or 18, respectively, are received in the same link elements 20 in the other or unconnected rows which are generally indicated at 44. As will be further seen from FIG. 2, the bracelet 12 comprises six rows of the shortened link elements 20 and therefore one of the unconnected rows 44 is positioned adjacent one of the side edges of the bracelet 12. Although it might otherwise be possible for the link elements 20 in this unconnected row 44 to slide off the legs 28 or 38 and move past the head portions 26 of their respective adjacent staple elements 16 or 18, the enlarged dimensions of the head portions 26 prevent this from happening and they also prevent the staple elements 16 or 18 from sliding inwardly toward the interior of the bracelet 12. Accordingly, the bracelet 12 can be effectively constructed with an even number of rows of link elements 20. In addition, since the head portions 26 are formed in enlarged dimensions, and preferably of substantially the same thickness as the link elements 20, they conceal the outwardly facing edges of the link elements 20 which are adjacent the side edges of the bracelet 12. Still further, since the head portions 26 of the staple elements 16 and 18 are formed with the notches 36 in the rearwardly facing portions thereof, the pairs of staple elements 16 and 18 can be disengaged from each other in order to adjust the length of the bracelet 12. Specifically, the pairs of link elements 16 and 18 can be disengaged from each other by inserting a prying instrument, such as a small screwdriver, into one of the notches 36 and twisting the instrument slightly to force the staple element 16 or 18 outwardly from the adjacent link elements 20 that it is disengaged from its respective staple element 16 or 18.

Accordingly, it is seen that the instant invention provides an effective and attractive bracelet construction which has significant advantages over the bracelet constructions of the prior art. Specifically, the end edges of the link elements 14 in the band 10 and the end edges of the link elements 20 which are adjacent the side edges of the band 12 are concealed by the head portions 26 of the adjacent staple elements 16 and 18 to provide enhanced aesthetic qualities in the bands 10 and 12. Further, the enlarged head portions 26 of the staple elements 16 and 18 enable the band 12 to be constructed with an even number of rows of the link elements 20, since the head portions 26 retain the staple elements 16 in properly assembled relation withe the link elements 20. Accordingly, it is seen that for these reasons as well as the other reasons hereinabove set forth the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a bracelet construction of the type comprising a longitudinally extending row of adjacent transversely extending, tubular link elements and a plurality of pairs of oppositely disposed male and female staple elements flexibly interconnecting said link elements, each of said staple elements comprising a head portion and a pair of spaced legs extending therefrom in generally parallel relation, the improvement comprising the head portion of each of said staple elements having a thickness which is greater than the thickness of the interior openings of the tubular link elements, the rear sides of said head portions being spaced from the adjacent link elements to define grooves therebetween which extend in substantially longitudinal relation with respect to said bracelet construction.

2. In the bracelet construction of claim 1, said link elements all being of substantially the same thickness, said head portions having thicknesses which are substantially the same as the thickness of said link elements whereby the end edges of said link elements are concealed by said head portions.

3. The bracelet construction of claim 1 further comprising a plurality of longitudinally extending rows of said link elements, the link elements in adjacent rows being longitudinally offset with respect to each other by approximately one-half the width of a link element, at least one staple element of each pair of staple elements being received in a link element of each row of the link elements.

4. In the bracelet construction of claim 3, there being an even number of said rows.

5. The bracelet construction of claim 2 further characterized as having front and rear sides, said link elements and said staple element head portions having front and rear sides, the front and rear sides of said link elements and the front and rear sides of the head portions of said staple elements cooperating to define the front and rear sides of said bracelet construction, the front and rear sides of said staple element head portions being substantially aligned with the front and rear sides, respectively, of the adjacent link elements.

6. A bracelet construction comprising an even mumber of longitudinally extending rows of adjacent transversely extending, tubular link elements of substantially uniform width, the link elements in adjacent rows being longitudinally offset with respect to each other by approximately one-half the width of a link element, and a plurality of pairs of oppositely disposed, interengaged, male and female staple elements flexibly interconnecting said link elements, each of said staple elements comprising a head portion and a pair of spaced legs extending therefrom in generally parallel relation, the legs of each staple element being interengaged with the legs of the other staple element of the same pair of staple elements, at least one pair of interengaged legs of each pair of staple elements passing through at least one link element of each row of link elements, the head portions of said staple elements having thicknesses which are greater than the thicknesses of the interior openings of their respective adjacent tubular link elements.

* * * * *